United States Patent [19]

Schimko

[11] 4,414,806

[45] Nov. 15, 1983

[54] NEEDLE SELECTION DEVICE FOR A KNITTING MACHINE

[75] Inventor: Reinhold Schimko, Aalen-Wasseralfingen, Fed. Rep. of Germany

[73] Assignee: Universal Maschinenfabrik Dr. Rudolf Schieber GmbH & Co., KG, Westhausen, Fed. Rep. of Germany

[21] Appl. No.: 419,899

[22] Filed: Sep. 20, 1982

[30] Foreign Application Priority Data

Sep. 24, 1981 [DE] Fed. Rep. of Germany ..... 3138035
Jul. 13, 1982 [DE] Fed. Rep. of Germany ..... 3226193

[51] Int. Cl.[3] ..... D04B 7/00
[52] U.S. Cl. ..... 66/75.2
[58] Field of Search ..... 66/75.2

[56] References Cited

U.S. PATENT DOCUMENTS

| | | | |
|---|---|---|---|
| 1,795,235 | 3/1931 | Ruinnet | 66/75.2 |
| 2,153,342 | 4/1939 | Ruinnet | 66/75.2 |
| 2,157,989 | 5/1939 | Lawson | 66/75.2 |
| 3,695,060 | 10/1972 | Flad | 66/75.2 |
| 3,974,664 | 8/1976 | Erb | 66/75.2 |
| 4,197,722 | 4/1980 | Cote-Petit et al. | 66/75.2 |

*Primary Examiner*—Ronald Feldbaum

*Attorney, Agent, or Firm*—Sughrue, Mion, Zinn, Macpeak and Seas

[57] ABSTRACT

In the needle selection device on a knitting machine equipped with a Jacquard mechanism, the knitting needles can be brought into various positions in which they are inactive, or are active for knitting, for forming tuck loops and for the transfer of stitches, with the aid of cam means on the carriage. In order to create a needle selection device which is simple in structure and is functionally reliable, blocking levers corresponding in number to the number of needle channels and arranged in accordance with the gauge of the needle separation are provided on a mounting rib extending over the length of the needle bed. At each selection position, on the carriage, there is provided a cam element for pivoting the blocking lever and also an electromagnet controllable for needle selection and having associated therewith a tripping pin for pivoting the blocking lever. The knitting needles, when selected for work, are held in pivoted positions by the respective blocking levers located in blocking positions, either directly or by way of a tilting lever associated with each needle. In order to avoid continuing vibration of the blocking levers following their pivotal movements two permanent magnets may be arranged on the carriage opposite the respective lever arms of each blocking lever.

10 Claims, 4 Drawing Figures

NEEDLE SELECTION DEVICE FOR A KNITTING MACHINE

FIELD OF THE INVENTION

This invention relates to a needle selection device for use on a knitting machine with a Jacquard mechanism, in which the knitting needles are brought in a controlled manner with the aid of cam elements on the knitting machine carriage into various positions in which they are inactive or are active for knitting, for forming tuck loops and for the transfer of stitches.

In order to be able to produce different knitted patterns on knitting machines it is necessary to incorporate a needle selection device by means of which the knitting needles can be selectively controlled in such a manner that they either remain out of action for a particular row of knitting, or knit stitches or form tuck loops. Furthermore, the needles can be selected also for the transfer and acceptance of stitches.

Certain known needle selection devices comprise pattern drums equipped with jacks, by means of which either selected jacks or the needles themselves can be directly controlled. Alternatively, it is known to use steel cards which, depending upon how the cards are stamped out, displace pattern jacks in the needle channels in the needle direction, this being known as shift Jacquard knitting. With lift-Jacquard knitting, the needles or pattern jacks are lifted up from below, and thus, depending upon how the steel cards are stamped out, the desired needle or pattern jack feet come into the cam region.

Electrical needle selection devices are also known which comprise electromagnets and permanent magnets on the machine carriage, these magnets attracting selection jacks in the one or other direction along the needle channels as they slide along, and with the electromagnets being controlled in accordance with the needle spacing.

Furthermore, needle selection devices are known in which, with the aid of a magnet at each selection position, each individual needle can be selected or not as the case may be. The selection elements slide past permanent magnets whose magnetic flux is partially blocked or released by a force field generated by a coil. However, the sliding of the selection elements past the permanent magnets gives rise to a very considerable degree of wear.

Mechanical blocking elements have also been proposed which store the designated needle selections and are controlled by the traversing of the carriage through the magnetic fields of electromagnets located on the carriage. The switched on time of the electromagnets on the carriage can here be limited to the movement time of the blocking elements, but there is nevertheless a great danger of erroneous switching since the magnetic fields must be limited in their physical extent.

SUMMARY OF THE INVENTION

It is an object of the present invention to provide a needle selection device of the type first referred to above which is simple in structure and which is safe and reliable in use.

This is achieved in accordance with the present invention by a needle selection device for a knitting machine with a Jacquard mechanism in which the knitting needles are brought in a controlled manner with the aid of cam means on the knitting machine carriage into various positions in which they are inactive, or are active for knitting, for forming tuck loops and for the transfer of stitches, in which blocking levers corresponding in number to the number of needle channels and arranged in accordance with the gauge of the needle spacing are provided on mounting means extending over the length of the needle bed, in which on the carriage at each needle selection position there is provided a cam element for pivoting the associated blocking lever and an electromagnet which is controllable for needle selection and which is provided with a tripping pin for pivoting the blocking lever, and in which the knitting needles either directly or by way of respective associated tilting levers, are held in pivoted positions selected for work by the respective blocking levers located in blocking positions.

According to a preferred embodiment of the needle selection device of the present invention, each knitting needle has associated therewith a tilting lever engaging the needle from below in the needle channel, each tilting lever having a lever arm remote from the knitting needle which is pivoted into the needle channel by a pressure cam element on the carriage and which is engaged and held down in the needle channel by the associated blocking lever which is positioned above the tilting lever in the blocking position.

The tilting lever preferably has a nose portion located beneath the associated blocking lever and which is arranged to engage the blocking lever when the latter is in its blocking position.

The pressure cam element preferably includes an inclined leading face for engagement with a foot of the tilting lever for each direction of traverse of the carriage.

Preferably, the blocking levers are pivotable into their release positions by the respective electromagnets and their tripping pins. Then, upon traverse of the carriage over the needle bed, the lever arms of the tilting levers which are remote from the knitting needles are pivoted by the pressure cam elements into the needle channels and the blocking levers are pivoted into their blocking positions by the cam elements provided for this. The pressure cam elements release each tilting lever at the selected positions for return pivotal movement under the action of the associated resilient knitting needle. If the corresponding knitting needle has been selected to be functional, then the electromagnet at this selection position is not energised, and the associated blocking lever remains in its blocking position, which means that the tilting lever can be pivoted back only until it strikes against the blocking lever and the associated knitting needle remains in a position selected for work. If, on the other hand, the electromagnet at the selection position is energised, then its armature displaces the tripping pin in the direction towards the associated blocking lever, the latter is pivoted into its release position, and the tilting lever can pivot back into a position in which the associated knitting needle is not selected for work.

The needle selection device of the present invention can alternatively be constructed in such a way that the blocking levers are switched into their blocking positions by the electromagnets and the tripping pins. With such an arrangement the blocking levers are pivoted into their release positions by the cam elements, and the energisation of the electromagnets at the selection positions is such that the associated blocking levers are pivoted into their blocking position by the pins. As a result the associated knitting needles are selected for operation.

The electromagnets are preferably pot-shaped shielded electromagnets so that a strong switching force can be achieved.

Furthermore, the electromagnets are preferably switched at high frequencies.

With the needle selection device of the present invention the needle selection is carried out mechanically and is stored by the blocking elements. The electromagnets are switched at high frequencies, and thereby very accurately with a strong switching force and with a very short switched-on time.

In a preferred embodiment two permanent magnets are arranged on the carriage opposite the respective lever arms of each blocking lever. By this means one avoids any post-vibration or continuing vibration of the blocking levers which might occur with very rapid pivotal movements, since each blocking lever is held by the permanent magnets in each of its two end positions.

Alternatively, or additionally, to the permanent magnets, one can provide brake devices on the mounting means, for example a bar which extends along the length of the needle bed, these brake devices being in the form of small spring plates for example, corresponding in number to the number of blocking levers, and which are brought into braking engagement with the blocking levers in each of the two end positions of these levers. This arrangement also ensures that one avoids any problems of continuing vibration of the blocking levers.

BRIEF DESCRIPTION OF THE DRAWINGS

In order that the invention may be fully understood one presently preferred embodiment of needle selection device in accordance with the invention will now be described by way of example and with reference to the accompanying drawings, in which.

DESCRIPTION OF THE PREFERRED EMBODIMENT

Figure 1:
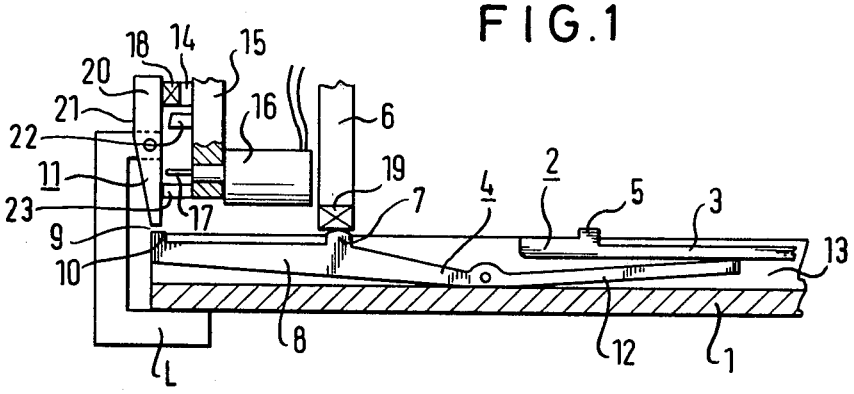
FIG. 1 is a partial cross-sectional view through a needle bed along the length of a needle channel and partly through the associated machine carriage, illustrating the needle selection device according to the present invention, with the carriage in its position shortly before the needle selection.

In the knitting machine, part of which is shown in the drawings, and which is equipped with a needle selection device in accordance with the invention, a tilting lever 4 is pivotally mounted at the lower end of each needle channel 13 of a needle bed 1. Each tilting lever 4 comprises a first lever arm 12, illustrated as the right-hand arm, which is positioned beneath the resilient shank 3 of the associated knitting needle 2 which is mounted displaceably in the needle bed 1. The other arm 8 of the tilting lever 4 is provided at its ends with a nose 10 which is positioned beneath a blocking lever 11 which is shown in its blocking position in FIG. 1.

A mounting bar L is fixed to the needle bed 1, and the blocking levers 11 are pivotally mounted on this bar so that they can pivot in respective vertical planes in the direction of the needle channels 13. Each needle channel 13, and consequently each tilting lever 4 has a blocking lever 11 associated therewith. The distance, i.e. spacing, from one blocking lever 11 to the next is 2.54 mm for an E10 gauge.

For each selection position there is provided on the machine carriage 15 an electromagnet 16 with a tripping pin 17 actuated by the armature of the electromagnet, the arrangement being such that at each electromagnet the associated blocking lever 11 can be pivoted into a release position by the pin 17. Furthermore, a pressure cam element 6 with an inclined leading face 19 is mounted on the carriage 15 and is arranged to make contact with a foot 7 on the lever arm 8 of the tilting lever 4. A needle cam element, which is not illustrated but which is likewise mounted on the carriage 15, is arranged to engage with a butt 5 of the knitting needle 2.

Furthermore, at each selection position, on the carriage 15, there is mounted a cam element 14 having an inclined leading face 18 with the aid of which the blocking lever 11 is pivoted into its blocking position upon advancing movement. In the position of the tilting lever 4 where it is depressed by the pressure cam element 6 a gap 9 is created, as is shown in FIG. 1, between the blocking lever 11 located in its blocking position and the nose 10 of the tilting lever 4.

Figure 2:
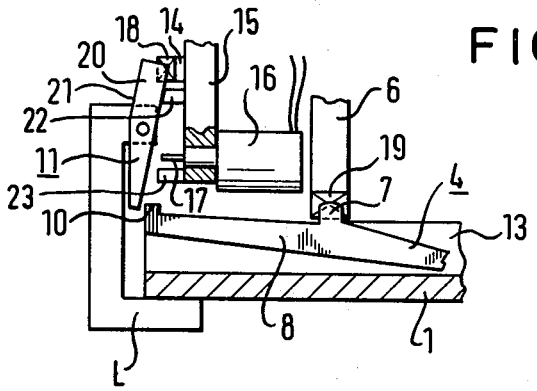
FIG. 2 is a partial view of the device shown in FIG. 1 with the carriage in the position before the beginning of the depression of the tilting lever and pivoting of the blocking lever into its blocking position.

Finally, two permanent magnets 22 and 23 are mounted on the carriage 15 opposite the two lever arms of the blocking lever 11. Of these magnets permanent magnet 22 holds the blocking lever 11, pivoted out by the tripping pin 17, until the tilting lever 4 has been released by the pressure cam element 6, as is shown in FIG. 2. Permanent magnet 23 holds the tilting lever 11, which has been brought by the cam element 14 to the pivot position shown in FIG. 1, until the pressure cam element 6 has released the tilting lever 4 and the nose 10 has come to rest against the blocking lever 11 as shown in FIG. 4.

The needle selection device of the present invention operates in the following manner.

Figure 3:
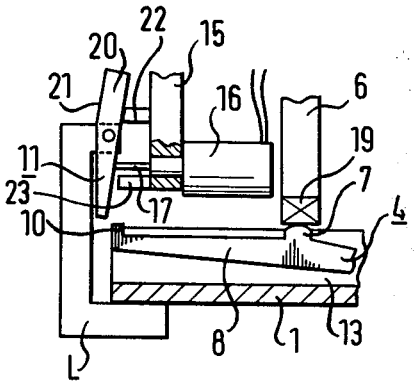
FIG. 3 is a partial view of the device of FIG. 1 with the blocking lever pivoted into its release position by the electromagnet; and, FIG. 4 is a partial view of the device of FIG. 1 with the tilting lever held by the blocking lever in its blocking position.
Figure 4:
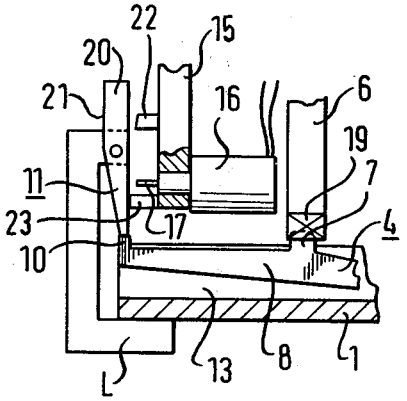

In the movement of the carriage 15 over the needle bed 1 the tilting lever 4 and the blocking lever 11 initially occupy the positions shown in FIG. 2 or FIG. 4, according to choice. Upon the further movement of the carriage 15, the tilting lever 4 is contacted at its foot 7 by the pressure cam element 6 and is pivoted in the needle bed. By means of the cam element 14 the blocking lever 11 (FIG. 2), which is in its release position and is held by permanent magnet 22, is pivoted into its blocking position in which it is taken over and held or fixed by permanent magnet 23. The various components then occupy the positions shown in FIG. 1. If now at any given selection position a knitting needle 2 is designated as one which is not required for work, then the electromagnet 16 associated with that needle is energised for a short time with the result that its tripping pin 17 pivots the corresponding blocking lever 11 into its release position in which this blocking lever is then held by permanent magnet 22, as is shown in FIG. 3. After release of the foot 7 of the tilting lever 8 from the pressure cam element 6 the lever arm 8 of the tilting lever 4 can then pivot upwards under the action of the resilient needle shank 3, and the butt 5 of the knitting needle 2 retracts into the needle bed so that it is not struck by the needle cam element.

If on the other hand, at any given selection position, the relevant knitting needle 2 is designated as one which is to be operational, then the associated electromagnet 16 is not energised, the associated blocking lever 11 remains in its blocking position in which it is held by permanent magnet 23, and the lever arm 8 of the tilting lever 4, after release of the foot 7 from the action of the pressure cam element 6, can only pivot into a position in which the nose 10 rests against the blocking lever 11 which is in its blocking position, as is shown in FIG. 4. The tilting lever 4 thus remains pivoted to such an extent that it holds up the shank 3 of the knitting needle 2, so that the needle butt 5 can be struck by the traversing needle cam element and the knitting needle 2 is functional.

If on the other hand one wishes the selection of the knitting needles 2 for use to be effected directly by energisation of the electromagnets 16 at the respective selection positions, then the electromagnets 16 should in this case be mounted on the carriage 15 in such a way that their tripping pins 17 strike against the upper arms 20 of the blocking levers 11 and the blocking levers 11 are therefore pivoted into the blocking positions. The cam element 14 with its inclined face 18 is then arranged on the carriage 15 so that its leading face 18 presses against the outer face 21 of the blocking lever 11 during the advancing movement and consequently always pivots the blocking lever 11 into the release position with such advance.

The electromagnets 16 are preferably pot-shaped shielded electromagnets in order to achieve a strong force. Furthermore, the electromagnets 16 are preferably switched with high frequency signals in order to achieve an accurate switching. The switching takes place very rapidly with a short "switched on" time at the respective selection positions since the selection which is thereby effected is effectively stored by the blocking levers 11.

I claim:

1. A needle selection device for a knitting machine with a Jacquard mechanism in which the knitting needles are brought in a controlled manner with the aid of cam means on the knitting machine carriage into various positions in which they are inactive, or are active for knitting, for forming tuck loops and for the transfer of stitches, in which blocking levers corresponding in number to the number of needle channels and arranged in accordance with the gauge of the needle spacing are provided on mounting means extending over the length of the needle bed, in which on the carriage at each needle selection position there is provided a cam element for pivoting the associated blocking lever and an electromagnet which is controllable for needle selection and which is pivoted with a tripping pin for pivoting the blocking lever, and in which the knitting needles, either directly or by way of respective associated tilting levers, are held in pivoted positions selected for work by the respective blocking levers located in blocking positions.

2. A needle selection device as claimed in claim 1, in which each knitting needle is associated with a tilting lever engaging it from below in the needle channel, each tilting lever having a lever arm remote from the knitting needle which is pivoted by a pressure cam element on the carriage into the needle channel and which is engaged by the associated blocking lever which is positioned above the lever arm in the blocking position and which holds the lever arm down in the needle channel.

3. A needle selection device as claimed in claim 2, in which each tilting lever has a nose portion beneath the associated blocking lever.

4. A needle selection device as claimed in claim 2 or 3, in which the pressure cam element has an inclined leading face for engagement with a foot of the tilting lever.

5. A needle selection device as defined in claim 1, in which the blocking levers are pivotable into their release positions by the respective electromagnets and tripping pins.

6. A needle selection device as defined in claims 1, in which the blocking levers are pivotable into their blocking positions by the respective electromagnets and tripping pins.

7. A needle selection device as defined in claim 1, in which each electromagnet is a pot-shaped shielded electromagnet.

8. A needle selection device as defined in claim 1, in which the electromagnets are switched by high frequency signals.

9. A needle selection device as claimed in claim 1, in which two permanent magnets are mounted on the carriage opposite the respective lever arms of each blocking lever.

10. A needle selection device as defined in claim 1, in which brake means for example in the form of small spring plates and corresponding in number to the number of blocking levers are arranged on said mounting means extending the length of the needle bed, said brake means being arranged to come into braking engagement with the blocking levers in each of the two end positions of the blocking levers.

* * * * *